United States Patent [19]

Swain

[11] 4,098,087

[45] Jul. 4, 1978

[54] ANCHORING BOLT AND METHOD

[75] Inventor: James C. Swain, Upper Arlington, Ohio

[73] Assignee: Battelle Development Corporation, Columbus, Ohio

[21] Appl. No.: 746,983

[22] Filed: Dec. 2, 1976

[51] Int. Cl.[2] ..... E21D 21/00

[52] U.S. Cl. ..... 61/45 B; 37/81; 175/171; 299/89; 408/204

[58] Field of Search ..... 61/45 B, 53.52, 63; 175/171, 177; 408/204, 205, 226, 207; 299/89; 173/57; 37/81, 82, 181

[56] References Cited

U.S. PATENT DOCUMENTS

| | | | |
|---|---|---|---|
| 2,786,284 | 3/1957 | Todd | 37/81 |
| 2,930,199 | 3/1960 | Jarund | 61/45 B |
| 3,250,170 | 5/1966 | Siegel | 61/45 BX |

FOREIGN PATENT DOCUMENTS

| | | | |
|---|---|---|---|
| 583,881 | 9/1933 | Fed. Rep. of Germany | 37/82 |
| 27,180 | 7/1909 | Sweden | 37/181 |

*Primary Examiner*—Jacob Shapiro
*Attorney, Agent, or Firm*—Philip M. Dunson; Barry S. Bissell

[57] ABSTRACT

A method of, and bolt for, supporting a structure such as a mine or tunnel roof or side wall or the like. The method typically comprises providing an elongate annular anchoring bolt defining a central longitudinal passage therethrough and having cutting edges in an inwardly extending region at its leading end and in outwardly protruding areas at spaced positions along and around its outer surface for cutting into the structure to be supported, and openings in the bolt adjacent to at least some of the cutting edges for permitting material that is cut away from the structure to proceed into the central passage and out through its trailing end, the outer diameter of the bolt being smaller at its leading end and progressively larger along its length to the trailing end, pressing the leading end of the bolt against a surface of the structure to be supported, applying axial and rotational forces against the bolt to drive its cutting edges against and into the structure along approximately parallel helical paths and to penetrate into the hole formed by the cutting until only a short minor portion of the bolt remains outside of the structure, and then applying a final axial force against the bolt sufficient to upset inwardly a portion of the bolt at its leading end and to drive the remaining portion of the bolt at the trailing end into the hole.

19 Claims, 7 Drawing Figures

ANCHORING BOLT AND METHOD

BACKGROUND

This invention relates to a method and bolt for supporting a structure such as a mine or tunnel roof or sidewall or the like. In presently known methods of anchoring for underground mines, tunnels, and the like it is necessary first to drill a hole in the structure to be consolidated, next to remove the drill from the hole, and then to place a bolt or other anchoring member in the hole. In the most common method of roof bolting, a bolt is inserted into the hole and is anchored tightly in place by means of expansion devices at or near its leading end. In another common method the anchoring member may fit in the hole with clearance, and the radial space between the anchoring member and the hole is filled with quick setting resinous materials, either along the entire length of the anchoring member or part of the way beginning at its leading end (the inner end of the hole). Recently other techniques have been pursued experimentally, and they are now in various stages of development. All currently used methods, however, require the separate operation of drilling a hole and removing the drill before the anchoring member can be placed within the structure that is to be supported.

The present invention eliminates the need for this separate step, and thus reduces the time and cost of the bolting operation, while increasing the safety of those who are performing it. This invention also achieves the desirable characteristics of gripping the structure along the entire length of the bolt, without the extra cost and time that are entailed in the use of resinous or other adhesives between the anchoring member and the structure to be consolidated.

SUMMARY

A typical method according to the present invention for supporting a structure such as a mine or tunnel roof or side wall or the like comprises providing an elongate annular anchoring bolt defining a central longitudinal passage therethrough and having cutting edges in an inwardly extending region at its leading end and in outwardly protruding areas at spaced positions along and around its outer surface for cutting into the structure to be supported, and openings in the bolt adjacent to at least some of the cutting edges for permitting material that is cut away from the structure to proceed into the central passage and out through its trailing end, the outer diameter of the bolt being smaller at its leading end and progressively larger along its length to the trailing end, pressing the leading end of the bolt against a surface of the structure to be supported, applying axial and rotational forces against the bolt to drive its cutting edges against and into the structure along approximately parallel helical paths and to penetrate into the hole formed by the cutting until only a short minor portion of the bolt remains outside of the structure, and then applying a final axial bore against the bolt sufficient to upset inwardly a portion of the bolt at its leading end and to drive the remaining portion of the bolt at the trailing end into the hole to provide an interference fit between the adjacent surfaces of the structure and the outwardly protruding areas of the bolt, and thus to provide a tight gripping force against the structure along substantially the entire length of the bolt.

Typically a short minor portion at the leading end of the bolt is connected to the remainder of the bolt in such manner as to be capable of transmitting the axial and rotational forces on the short minor portion in the cutting and penetrating step without disconnecting from the remainder of the bolt, and to disconnect therefrom upon the application of the final axial force for driving the trailing end portion into the hole, so that the driven remainder of the bolt at its leading end moves between the outer surface of the hole into a telescoped interference fit of the outwardly protruding areas therewith. Preferably the axial and rotational forces applied against the bolt are maintained at about the minimum values required to cut and pentrate into the hole, at a reasonable rate, as determined by the increasing resistance as the penetration proceeds.

Typically the cutting edges are approximately evenly distributed along and around the bolt except in the minor portion that remains outside of the structure during the cutting of the hole therein, where they of course are not needed. In some embodiments, the openings in the bolt are provided only adjacent the cutting edges in a portion of the bolt extending from the leading end partially along its length. The portion of the surface ahead of the cutting edge of each protruding area, and the adjacent opening, typically extends inwardly from the surrounding surface region of the bolt.

The cutting edges of the outwardly protruding areas typically extend radially beyond the surrounding surface region sufficiently to cut a hole that is large enough to provide a suitable passage for the flow of air and dust between the bolt and the structure and into the openings in the bolt. Typically each cutting edge either forms a line that is approximately parallel to the axis of the bolt; or else forms a line that is tilted backwardly at an acute angle to the axis of the bolt. The typical protruding area makes a small angle with the surrounding surface region at its leading end to facilitate penetration by the bolt into the hole during the cutting and during the final axial drive, and makes a large angle with the surrounding surface region at its trailing end to promote the holding of the bolt tightly in place after it has been driven entirely into the hole. The bolt may also have outwardly protruding areas without cutting edges approximately evenly distributed along and around the bolt, with each protruding region making a small angle with the surrounding surface region at its leading end to facilitate penetration by the bolt into the hole during the final axial drive, and making a large angle with the surrounding surface region at its trailing end to promote the holding of the bolt tightly in place after it has been driven entirely into the hole.

In some typical embodiments the outer diameter of the bolt increases substantially linearly from its leading end to its trailing end. In others, the outer diameter of the bolt increases in steps of approximately equal length from its leading end to its trailing end. A plurality of cutting edges typically are provided in the surface between the trailing end of each smaller-diameter step and the leading end of the next larger-diameter step, except in the surface between the last two steps at the trailing end of the bolt. Typically the axial and rotational forces are applied until all except the last step at the trailing end of the bolt have penetrated into the hole, and then the final axial force drives each step into an interference fit of the outwardly protruding areas within the portion of the hole that was cut away by the preceding step, the region at the leading end of the bolt being connected to the first step in such manner as to be capable of transmitting the axial and rotational forces applied to the leading region during the cutting and penetrating without disconnecting from the first step, and to disconnect therefrom upon the application of the final axial force, so that the first step moves between the outer surface of the disconnected region at the leading end of the bolt and the inner surface of the hole into a telescoped interference fit of the outwardly protruding areas therewith.

Typically an outwardly projecting flange at the trailing end of the bolt holds a plate that has been placed around the bolt and the final axial force drives the flange and the plate into tight contact with the surface of the structure to provide support for the surface.

A typical bolt according to the present invention for supporting a structure such as a mine or tunnel roof or side wall or the like, comprises an elongate annular body defining a central longitudinal passage therethrough and having cutting edges in an inwardly extending region at its leading end and in outwardly protruding areas at spaced positions along and around its outer surface for cutting into the structure to be supported, and openings in the body adjacent to at least some of the cutting edges for permitting material that is cut away from the structure to proceed into the central passage and out through its trailing end, the outer diameter of the body being smaller at its leading end and progressively larger along its length to the trailing end, the body comprising a short minor portion at its leading end connected to the remainder of the body by connecting means weaker than the body, but strong enough to be capable of transmitting substantial axial and rotational forces from the remainder of the body to the short minor portion of the body at its leading end without disconnecting, so that by pressing the leading end of the body against the surface of the structure to be supported, applying axial and rotational forces against the body to drive its cutting edges against and into the structure along approximately parallel helical paths and to penetrate into the hole formed by the cutting until only a short minor portion of the body remains outside the structure, and then applying a final axial force against the body sufficient to upset inwardly a portion of the body at its leading end and to drive the remaining portion of the body at the trailing end into the hole, an interference fit can be provided between the adjacent surfaces of the structure and the outwardly protruding areas of the body of the bolt, and thus a tight gripping force can be achieved along substantially the entire length of the bolt.

Typically a short minor portion at the leading end of the body is connected at the outer surface of its trailing end to the inner surface of the leading end of the remainder of the body in such manner as to be capable of transmitting the axial and rotational forces normally present on the short minor portion for cutting and penetrating without disconnecting from the remainder of the body, and to disconnect therefrom upon the application of a final axial force for driving the trailing end portion into a hole, so that the driven remainder of the bolt at its leading end can move between the outer surface of the disconnected minor portion and the inner surface of the hole into a telescoped interference fit of the outwardly protruding areas therewith.

Typically the cutting edges are approximately evenly distributed along and around the body except in the minor portion that is intended to remain outside of a structure during the cutting of a hole therein. In some embodiments, the openings in the body are provided only adjacent the cutting edges in a portion of the body extending from the leading end partially along its length. The portion of the surface ahead of each protruding area that has a cutting edge and an adjacent opening, typically extends inwardly from the surrounding surface region of the body.

The cutting edges of the outwardly protruding areas typically extend radially beyond the surrounding surface region sufficiently to cut a hole that is large enough to provide a suitable passage for the flow of air and dust between the body and the structure and into the openings in the body. Typically each cutting edge either forms a line that is approximately parallel to the axis of the body; or else forms a line that is tilted backwardly at an acute angle to the axis of the body.

The protruding area makes a small angle with the surrounding surface region at its leading end to facilitate penetration by the bolt into a hole during cutting and during a final axial drive, and makes a large angle with the surrounding surface region at its trailing end to promote the holding of the bolt tightly in place after it has been driven entirely into the hole. The body may also have outwardly protruding areas without cutting edges approximately evenly distributed along and around the bolt, with each protruding region making a small angle with the surrounding surface region at its leading end to facilitate penetration by the body into a hole during a final axial drive, and making a large angle with the surrounding surface region at its trailing end to promote the holding of the bolt tightly in place after it has been driven entirely into the hole.

In some typical embodiments, the outer diameter of the body increases substantially linearly from its leading end to its trailing end. In others, the outer diameter of the body increases in steps of approximately equal length from its leading end to its trailing end. Typically the increase in diameter is approxiately equal from one step to the next. A plurality of cutting edges typically are provided in the surface between the trailing end of each smaller-diameter step and the leading end of the next larger-diameter step, except in the surface between the last two steps at the trailing end of the bolt.

In a typical bolt, suitable for uses wherein axial and rotational forces are applied until all except the last step at the trailing end of the bolt have penetrated into a hole, and then a final axial force drives each step into an interference fit of the outwardly protruding areas within the portion of the hole that was cut away by the preceding step, the region at the leading end of the body is connected to the first step in such manner as to be capable of transmitting the axial and rotational forces normally applied to the leading region for cutting and penetrating without disconnecting from the first step, and to disconnect therefrom upon the application of a final axial force, so that the first step can move between the outer surface of the disconnected region at the leading end of the body and the inner surface of the hole into a telescoped interference fit of the outwardly protruding areas therewith.

Typically an outwardly projecting flange at the trailing end of the body holds a plate that has been placed around the body so that a final axial force can drive the flange and the plate into tight contact with the surface of the structure to provide support for the surface.

DRAWINGS

PREFERRED EMBODIMENTS

Figures 1, 2, 3, 4:
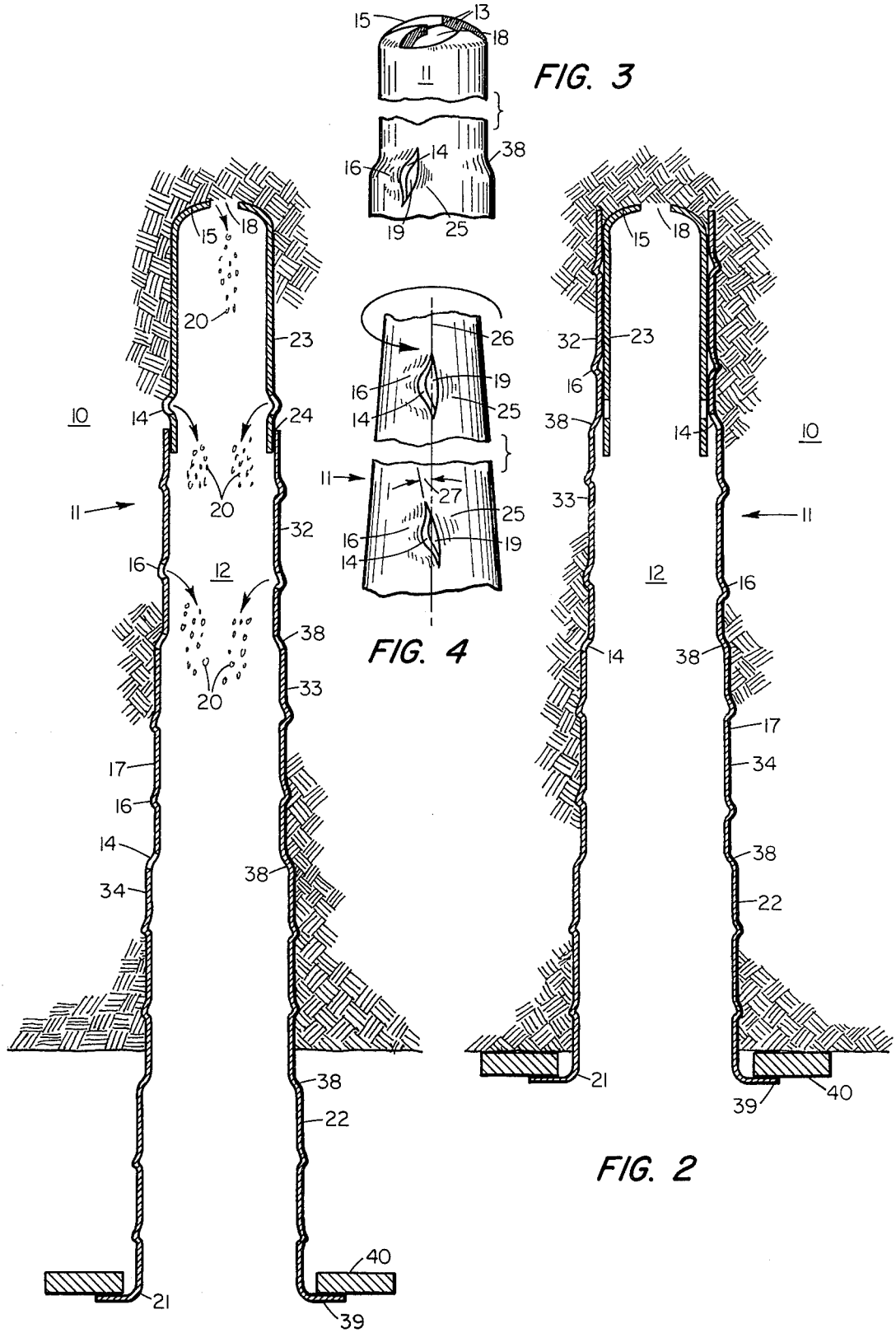
FIG. 1 is a sectional view of a typical form of bolt according to the present invention that has been drilled most of its way into a structure to be supported, by the application of axial and rotational forces.
FIG. 2 is a similar view of the bolt in FIG. 1, after is has been pressed the rest of the way into the structure.
FIG. 3 is an enlarged perspective view of part of the leading end of a bolt as in FIG. 1.
FIG. 4 is an enlarged perspective view of a portion of another typical form of bolt according to this invention.

A typical method according to the present invention for supporting a structure 10 such as a mine or tunnel roof or side wall or the like comprises providing an elongate annular anchoring bolt 11 defining a central longitudinal passage 12 therethrough and having cutting edges 13, 14 in an inwardly extending region at its leading end 15 and in outwardly protruding areas 16 at spaced positions along and around its outer surface 17 for cutting into the structure 10 to be supported, and openings 18, 19 in the bolt 11 adjacent to at least some of the cutting edges 13, 14 for permitting material 20 that is cut away from the structure 10 to proceed into the central passage 12 and out through its trailing end 21, the outer diameter of the bolt 11 being smaller at its leading end 15 and progressively larger along its length to the trailing end 21, pressing the leading end 15 of the bolt 11 against a surface of the structure 10 to be supported, applying axial and rotational forces against the bolt 11 to drive its cutting edges 13, 14 against and into the structure 10 along approximately parallel helical paths and to penetrate into the hole formed by the cutting until only a short minor portion 22 of the bolt 11 remains outside of the structure 10, and then applying a final axial force against the bolt 11 sufficient to upset inwardly a portion 23 of the bolt 11 at its leading end 15 and to drive the remaining portion 22 of the bolt 11 at the trailing end 21 into the hole to provide an interference fit between the adjacent surfaces of the structure 10 and the outwardly protruding areas 16 of the bolt 11, and thus to provide a tight gripping force against the structure 10 along substantially the entire length of the bolt 11.

Figure 7:
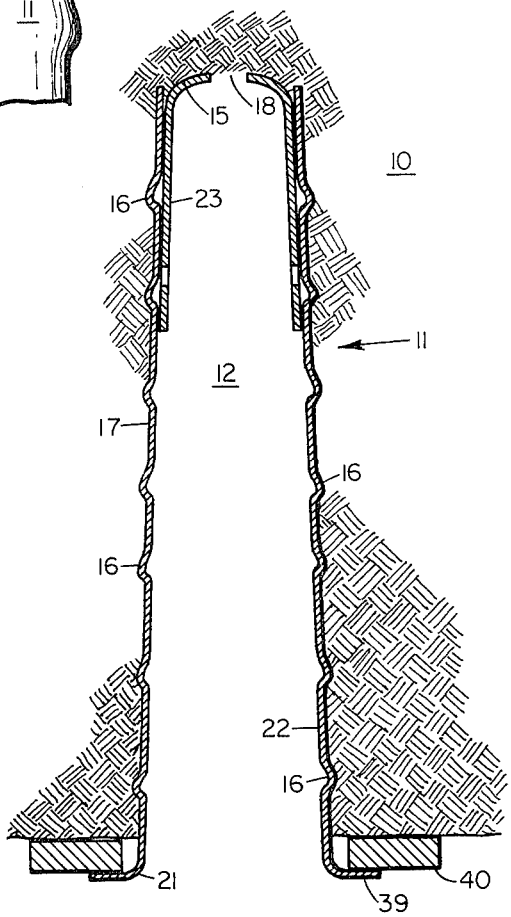
FIG. 7 is a similar view of the bolt in FIG. 6, after it has been pressed the rest of the way into the structure.

Typically a short minor portion 23 at the leading end 15 of the bolt 11 is connected, as indicated at 24, to the remainder of the bolt 11 in such manner as to be capable of transmitting the axial and rotational forces on the short minor portion 23 in the cutting and penetrating step without disconnecting from the remainder of the bolt 11, and to disconnect therefrom upon the application of the final axial force for driving the trailing end portion 22 into the hole, so that the driven remainder of the bolt 11 at its leading end (at 24) moves between the outer surface 17 of the disconnected minor portion 23 and the inner surface of the hole into a telescoped interference fit (as shown in FIGS. 2 and 7) of the outwardly protruding areas 16 therewith. The leading end portion 23 of course must be at least as long as the trailing end portion 22 that extends beyond the hole before the final axial driving force is applied. Preferably the axial and rotational forces applied against the bolt 11 are maintained at about the minimum values required to cut and penetrate into the hole, at a reasonable rate, as determined by the increasing resistance as the penetration proceeds.

Typically the cutting edges 14 are approximately evenly distributed along and around the bolt 11; except in the minor portion 22 that remains outside of the structure 10 during the cutting of the hole therein, where they of course are not needed. In some embodiments, the openings 19 in the bolt 11 are provided only adjacent the cutting edges 14 in a portion of the bolt 11 extending from the leading end 15 partially along its length. The cutting edges 13, 14 may or may not be hardened by various methods such as heat treatment or coatings, depending on the difficulty of cutting the particular structure 10. The portion 25 of the surface 17 ahead of each protruding area 16 having a cutting edge 14 and an adjacent opening 19, typically extends inwardly from the surrounding surface region of the bolt 11.

The cutting edges 14 of the outwardly protruding areas 16 typically extend radially beyond the surrounding surface region 17 sufficiently to cut a hole that is large enough to provide a suitable passage for the flow of air and dust between the bolt 11 and the structure 10 and into the openings 19 in the bolt 11. Typically each cutting edge 14 either forms a line that is approximately parallel to the axis 26 of the bolt 11, as shown in the upper part of FIG. 4; or else forms a line that is tilted backwardly at an acute angle 27 to the axis 26 of the bolt 11, as shown in the lower part of FIG. 4. Typically the areas 16 without cutting edges do not protrude outwardly quite as far as the areas 16 having cutting edges 14 thereon. The relative radial extension of the two types of protruding areas 16 determines the characteristics of the interference or gripping with the structure 10 after the final axial force has driven the bolt entirely into the hole. Depending upon the material in the structure 10, the radial extensions may or may not be designed to be constant along the length of the bolt 11.

Figure 5:
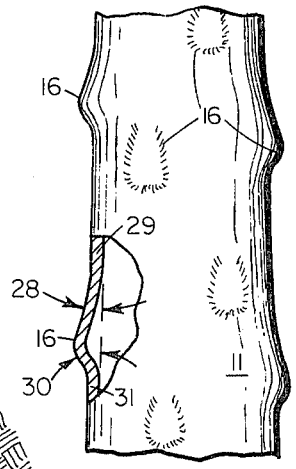
FIG. 5 is a similar view, partly cut away showing further details in a typical bolt as in FIG. 4.

Referring now to FIG. 5, the typical protruding area 16 makes a small angle 28 with the surrounding surface region 17 at its leading end 29 to facilitate penetration by the bolt 11 into the hole during the cutting and during the final axial drive, and makes a large angle 30 with the surrounding surface region 17 at its trailing end 31 to promote the holding of the bolt 11 tightly in place after it has been driven entirely into the hole. The bolt 11 may also have outwardly protruding areas 16 without cutting edges approximately evenly distributed along and around the bolt 11, with each protruding region 16 making a small angle 28 with the surrounding surface region 17 at its leading end 29 to facilitate penetration by the bolt 11 into the hole during the final axial drive, and making a large angle 30 with the surrounding surface region 17 at its trailing end 31 to promote the holding of the bolt 11 tightly in place after it has been driven entirely into the hole.

Figure 6:
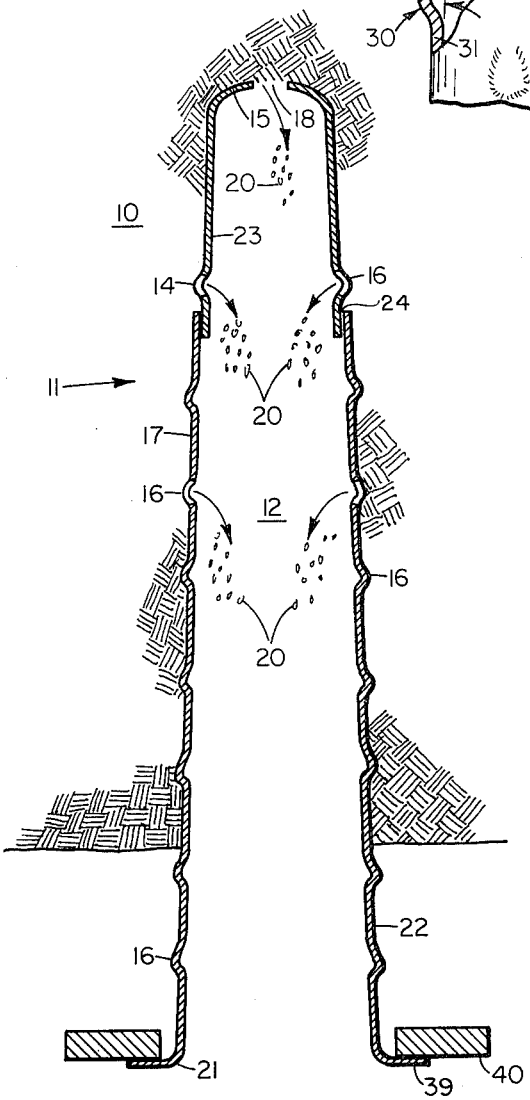
FIG. 6 is a sectional view, similar to FIG. 1, showing another typical form of bolt according to this invention that has been drilled most of its way into a structure to be supported.

In some typical embodiments, such as those in FIGS. 6 and 7, the outer diameter of the bolt 11 increases substantially linearly from its leading end 15 to its trailing end 21. In others, such as those in FIGS. 1 and 2, the outer diamter of the bolt 11 increases in steps 32, 33, 34, 22 of approximately equal length from its leading end 15 to its trailing end 21. Typically the increase in diameter is approximately equal from each step to the next. A plurality of cutting edges 14 typically are provided in the surface 38 between the trailing end of each smaller-diameter step and the leading end of the next larger-diameter step, except in the surface between the last two steps 34, 22 at the trailing end 21 of the bolt 11. Typically the axial and rotational forces are applied until all except the last step 22 at the trailing end 21 of the bolt 11 have penetrated into the hole, and then the final axial force drives each step into an interference fit of the outwardly protruding areas 16 within the portion of the hole that was cut away by the preceding step, the region 23 at the leading end 15 of the bolt 11 being connected, as indicated at 24, to the first step 32 in such manner as to be capable of transmitting the axial and rotational forces applied to the leading region 23 during the cutting and penetrating without disconnecting from the first step 32, and to disconnect therefrom upon the application of the final axial force, so that the first step 32 moves between the outer surface 17 of the disconnected region 23 at the leading end of the bolt 11 and the inner surface of the hole into a telescoped interference fit (as shown in FIG. 2) of the outwardly protruding areas 16 therewith. The leading end region 23 of course must be at least as long as the first step 32, which must be at least as long as the next step 33, which must be at least as long as the next step 34, which must be at least as long as the trailing step 22. Ordinarily the steps 32, 33, 34, 22 are approximately equal in length. Of course more or fewer steps may be included, as needed.

Typically an outwardly projecting flange 39 at the trailing end 21 of the bolt 11 holds a plate 40 that has been placed around the bolt 11 and the final axial force drives the flange 39 and the plate 40 into tight contact with the surface of the structure 10 to provide support for the surface. Flat inner surfaces at the trailing end 21 of the bolt 11, or gripping means (not shown) on the projecting flange 39, may be provided so that a torque wrench can be applied to the bolt 11 to check the tightness of the fit of the bolt 11 in the structure 10.

A typical bolt 11 according to the present invention for supporting a structure 10 such as a mine or tunnel roof or side wall or the like, comprises an elongate annular body 11 defining a central longitudinal passage 12 therethrough and having cutting edges 13, 14 in an inwardly extending region at its leading end 15 and in outwardly protruding areas 16 at spaced positions along and around its outer surface 17 for cutting into the structure 10 to supported, and openings 18, 19 in the body 11 adjacent to at least some of the cutting edges 13, 14 for permitting material 20 that is cut away from the structure 10 to proceed into the central passage 12 and out through its trailing end 21, the outer diameter of the body 11 being smaller at its leading end 15 and progressively larger along its length to the trailing end 21, the body 11 comprising a short minor portion 23 at its leading end 15 connected to the remainder of the body 11 by connecting means at 24 weaker than the body 11, but strong enough to be capable of transmitting substantial axial and rotational forces from the remainder of the body 11 to the short minor portion 23 of the body 11 at its leading end without disconnecting, so that by pressing the leading end 15 of the body 11 against the surface of the structure 10 to be supported, applying axial and rotational forces against the body 11 to drive its cutting edges 13, 14 against and into the structure 10 along approximately parallel helical paths and to penetrate into the hole formed by the cutting until only a short minor portion 22 of the body 11 remains outside the structure 10, and then applying a final axial force against the body 11 sufficient to upset inwardly a portion 23 of the body 11 at its leading end 15 and to drive the remaining portion 22 of the body 11 at the trailing end 21 into the hole, an interference fit can be provided between the adjacent surfaces of the structure 10 and the outwardly protruding areas 16 of the body of the bolt 11, and thus a tight gripping force can be achieved along substantially the entire length of the bolt 11.

Typically a short minor portion 23 at the leading end 15 of the body 11 is connected, as indicated at 24, at the outer surface of its trailing end, at 24, to the inner surface of the leading end, also at 24, of the remainder of the body 11 in such manner as to be capable of transmitting the axial and rotational forces normally present on the short minor portion 23 for cutting and penetrating without disconnecting from the remainder of the body 11, and to disconnect therefrom upon the application of a final axial force for driving the trailing end portion 22 into a hole, so that the driven remainder of the bolt 11 at its leading end (at 24) can move between the outer surface 17 of the disconnected minor portion 23 and the inner surface of the hole into a telescoped interference fit (as shown in FIGS. 2 and 7) of the outwardly protruding areas 16 therewith. The leading end portion 23 of course must be at least as long as the trailing end portion 22 that extends beyond the hole before the final axial driving force is applied.

Typically the cutting edges 14 are approximately evenly distributed along and around the body 11; except in the minor portion 22 that is intended to remain outside of a structure during the cutting of a hole therein, where they of course are not needed. In some embodiments, the openings 19 in the body 11 are provided only adjacent the cutting edges 14 in a portion of the body 11 extending from the leading end 15 partially along its length. The cutting edges 13, 14 may or may not be hardened by various methods such as heat treatment or coatings, depending on the difficulty of cutting the particular structure 10. The portion 25 of the surface 17 ahead of each protruding area 16 having a cutting edge 14 and an adjacent opening 19, typically extends inwardly from the surrounding surface region of the body 11.

The cutting edges 14 of the outwardly protruding areas 16 typically extend radially beyond the surrounding surface region 17 sufficiently to cut a hole that is large enough to provide a suitable passage for the flow of air and dust between the body 11 and the structure 10 and into the openings 19 in the body 11. Typically each cutting edge 14 either forms a line that is approximately parallel to the axis 26 of the body 11, as shown in the upper part of FIG. 4; or else forms a line that is tilted backwardly at an acute angle 27 to the axis 26 of the body 11, as shown in the lower part of FIG. 4. Typically the areas 16 without cutting edges do not protrude outwardly quite as far as the areas 16 having cutting edges 14 thereon. The relative radial extension of the two types of protruding areas 16 determines the characteristics of the interference or gripping with the structure 10 after the final axial force has driven the bolt entirely into the hole. Depending upon the material in the structure 10, the radial extensions may or may not be designed to be constant along the length of the bolt 11.

Referring now to FIG. 5, the typical protruding areas 16 makes a small angle 28 with the surrounding surface region 17 at its leading end 29 to facilitate penetration by the bolt 11 into a hole during cutting and during a final axial drive, and makes a large angle 30 with the surrounding surface region 17 at its trailing end 31 to promote the holding of the bolt 11 tightly in place after it has been driven entirely into the hole. The body 11 may also have outwardly protruding areas 16 without cutting edges approximately evenly distributed along and around the bolt 11, with each protruding region 16 making a small angle 28 with the surrounding surface region 17 at its leading end 29 to facilitate penetration by the body 11 into a hold during a final axial drive, and making a large angle 30 with the surrounding surface region 17 at its trailing end 31 to promote the holding of the bolt 11 tightly in place after it has been driven entirely into the hole.

In some typical embodiments, such as those in FIGS. 6 and 7, the outer diameter of the body 11 increases substantially linearly from its leading end 15 to its trailing end 21. In others such as those in FIGS. 1 and 2, the outer diameter of the body 11 increases in steps 32, 33, 34, 22 of approximately equal length from its leading end 15 to its trailing end 21. Typically the increase in diameter is approximately equal from one step to the next. A plurality of cutting edges 14 typically are provided in the surface 38 between the trailing end of each smaller-diameter step and the leading end of the next larger-diameter step, except in the surface between the last two steps 32, 22 at the trailing end 21 of the bolt 11.

In a typical bolt 11, suitable for uses wherein axial and rotational forces are applied until all except that last step 22 at the trailing end 21 of the bolt 11 have penetrated into a hole, and then a final axial force drives each step into an interference fit of the outwardly protruding areas 16 within the portion of the hole that was cut away by the preceding step, the region 23 at the leading end 15 of the body 11 is connected, as indicated at 24, to the first step 32 in such manner as to be capable of transmitting the axial and rotational forces normally applied to the leading region 23 for cutting and penetrating without disconnecting from the first step 32, and to disconnect therefrom upon the application of a final axial force, so that the first step 32 can move between the outer surface 17 of the disconnected region 23 at the leading end of the body 11 and the inner surface of the hole into a telescoped interference fit (as shown in FIG. 2) of the outwardly protruding areas 16 therewith. The leading end region 23 of course must be at least as long as the first step 32, which must be at least as long as the next step 33, which must be at least as long as the next step 34, which must be at least as long as the trailing step 22. Ordinarily the steps 32, 33, 34, 22 are approximately equal in length. Of course more or fewer steps may be included, as needed.

Typically an outwardly projecting flange 39 at the trailing end 21 of the body 11 holds a plate 40 that has been placed around the body 11 so that a final axial force can drive the flange 39 and the plate 40 into tight contact with the surface of the structure 10 to provide support for the surface. Flat inner surface at the trailing end 21 of the bolt 11, or gripping means (not shown) on the projecting flange 39, may be provided so that a torque wrench can be applied to the bolt 11 to check the tightness of the fit of the bolt 11 in the structure 10.

The thickness of the wall of the bolt 11 may be constant along its length, for simplicity of manufacture; or the thickness may vary along the length, for most efficient utilization of the material.

For the convenience of the reader, the following list identifies the item or detail indicated by each reference numeral therein.

| Reference numeral | Item or Detail |
|---|---|
| 10 | structure |
| 11 | bolt (body) |
| 12 | central passage |
| 13 | cutting edges at top 15 |
| 14 | cutting edges in protrusions 16 |
| 15 | leading end |
| 16 | protruding areas (with and without cutting edges) |
| 17 | outer surface |
| 18 | openings at top by 13 |
| 19 | openings by 14 |
| 20 | material cut away |
| 21 | trailing end |
| 22 | trailing portion |
| 23 | leading portion |
| 24 | collapsible joint |
| 25 | inwardly bent portions |
| 26 | axis of bolt |
| 27 | angle between 14 and 26 |
| 28 | angle at 29 |
| 29 | leading end of 16 |
| 30 | angle at 31 |
| 31 | trailing end of 16 |
| 32,33,34 | steps |
| 38 | surface between steps |
| 39 | supporting flange |
| 40 | plate |

While the forms of the invention herein disclosed constitute presently preferred embodiments, many other are possible. It is not intended herein to mention all of the possible equivalent forms or ramifications of the invention. It is to be understood that the terms used herein are merely descriptive rather than limiting, and that various changes may be made without departing from the spirit or scope of the invention.

I claim:

1. A method of supporting a structure such as a mine or tunnel roof or side wall or the like, comprising providing an elongate annular anchoring bolt defining a central longitudinal passage therethrough and having cutting edges in an inwardly extending region at its leading end and in outwardly protruding areas at spaced positions along and around its outer surface for cutting into the structure to be supported, and openings in the bolt adjacent to at least some of the cutting edges for permitting material that is cut away from the structure to proceed into the central passage and out through its trailing end, the outer diameter of the bolt being smaller at its leading end and progressively larger along its length to the trailing end, pressing the leading end of the bolt against a surface of the structure to be supported, applying axial and rotational forces against the bolt to drive its cutting edges against and into the structure along approximately parallel helical paths and to penetrate into the hole formed by the cutting until only a short minor portion of the bolt remains outside of the structure, and then applying a final axial force against the bolt sufficient to upset inwardly a portion of the bolt at its leading end and to drive the remaining portion of the bolt at the trailing end into the hole to provide an interference fit between the adjacent surfaces of the structure and the outwardly protruding areas of the bolt, and thus to provide a tight gripping force against the structure along substantially the entire length of the bolt.

2. A method as in claim 1, wherein the axial and rotational forces applied against the bolt are maintained at about the minimum values required to cut and penetrate into the hole, at a reasonable rate, as determined by the increasing resistance as the penetration proceeds.

3. A method as in claim 1, wherein the outer diameter of the bolt increases in steps of approximately equal length from its leading end to its trailing end;

wherein a plurality of cutting edges are provided in the surface between the trailing end of each smaller-diameter step and the leading end of the next larger-diameter step, except in the surface between the last two steps at the trailing end of the bolt; and wherein the axial and rotational forces are applied until all except the last step at the trailing end of the bolt have penetrated into the hole, and then the final axial force drives each step into an interference fit of the outwardly protruding areas within the portion of the hole that was cut away by the preceding step, the region at the leading end of the bolt being connected to the first step in such manner as to be capable of transmitting the axial and rotational forces applied to the leading region during the cutting and penetrating without disconnecting from the first step, and to disconnect therefrom upon the application of the final axial force, so that the first step moves between the outer surface of the disconnected region at the leading end of the bolt and the inner surface of the hole into a telescoped interference fit of the outwardly protruding areas therewith.

4. A method as in claim 1, wherein an outwardly projecting flange at the trailing end of the bolt holds a plate that has been placed around the bolt and the final axial force drives the flange and the plate into tight contact with the surface of the structure to provide support for the surface.

5. A bolt for supporting a structure such as a mine or tunnel roof or side wall or the like, comprising an elongate annular body defining a central longitudinal passage therethrough and having curring edges in an inwardly extending region at its leading end and in outwardly protruding areas at spaced positions along and around its outer surface for cutting into the structure to be supported, and openings in the body adjacent to at least some of the cutting edges for permitting material that is cut away from the structure to proceed into the central passage and out through its trailing end, the outer diameter of the body being smaller at its leading end and progressively larger along its length to the trailing end, the body comprising a short minor portion at its leading end connected to the remainder of the body by connecting means weaker than the body, but strong enough to be capable of transmitting substantial axial and rotational forces from the remainder of the body to the short minor portion of the body at its leading end without disconnecting, so that by pressing the leading end of the body against the surface of the structure to be supported, applying axial and rotational forces against the body to drive its cutting edges against and into the structure along approximately parallel helical paths and to penetrate into the hole formed by the cutting until only a short minor portion of the body at its trailing end remains outside the structure, and then applying a final axial force against the body sufficient to upset inwardly the portion of the body at its leading end and to drive the remaining portion of the body at the trailing end into the hole, an interference fit can be provided between the adjacent surfaces of the structure and outwardly protruding areas of the body of the bolt, and thus a tight gripping force can be achieved along substantially the entire length of the bolt.

6. A bolt as claimed in claim 5, wherein the short minor portion at the leading end of the body is connected at the outer surface of its trailing end to the inner surface of the leading end of the remainder of the body and thus to be capable of transmitting the axial and rotational forces normally present on the short minor portion for cutting and penetrating without disconnecting from the remainder of the body, and to disconnect therefrom upon the application of a final axial force for driving the trailing end portion into a hole, so that the driven remainder of the bolt at its leading end can move between the outer surface of the disconnected minor portion and the inner surface of the hole into a telescoped intereference fit of the outwardly protruding areas therewith.

7. A bolt as in claim 5, wherein the cutting edges are approximately evenly distributed along and around the body except in the minor portion that is intended to remain outside of a structure during the cutting of a hole therein.

8. A bolt as in claim 7, wherein the openings in the body are provided only adjacent the cutting edges in a portion of the body extending from the leading end partially along its length.

9. A bolt as in claim 5, wherein the portion of the surface ahead of the cutting edge of each protruding area, and the adjacent opening, extends inwardly from the surrounding surface region of the body.

10. A bolt as in claim 5, wherein the cutting edges of the outwardly protruding areas extend radially beyond the surrounding surface region sufficiently to cut a hole that is large enough to provide a suitable passage for the flow of air and dust between the body and the structure and into the openings in the body.

11. A bolt as in claim 5, wherein each cutting edge forms a line that is approximately parallel to the axis of the body.

12. A bolt as in claim 5, wherein each cutting edge forms a line that is tilted backwardly at an acute angle to the axis of the body.

13. A bolt as in claim 5, wherein the protruding area makes a small angle with the surrounding surface region at its leading end to facilitate penetration by the bolt into a hole during cutting and during a final axial drive, and makes a large angle with the surrounding surface region at its trailing end to promote the holding of the bolt tightly in place after it has been driven entirely into the hole.

14. A bolt as in claim 5, wherein the body also has outwardly protruding areas without cutting edges approximately evenly distributed along and around the bolt, with each protruding region making a small angle with the surrounding surface region at its leading end to facilitate penetration by the body into a hole during a final axial drive, and making a large angle with the surrounding surface region at its trailing end to promote the holding of the bolt tightly in place after it has been driven entirely into the hole.

15. A bolt as in claim 5, wherein the outer diameter of the body increases substantially linearly from its leading end to its trailing end.

16. A bolt as in claim 5, wherein the outer diameter of the body increases in steps of approximately equal length from its leading end to its trailing end.

17. A bolt as in claim 16, wherein a plurality of cutting edges are provided in the surface between the trailing end of each smaller-diameter step and the leading end of the next larger-diameter step, except in the surface between the last two steps at the trailing end of the bolt.

18. A bolt as in claim 17, suitable for uses wherein axial and rotational forces are applied until all except the last step at the trailing end of the bolt have penetrated into a hole, and then a final axial force drives each step into an interference fit of the outwardly protruding areas within the portion of the hole that was cut away by the preceding step, and wherein the region at the leading end of the body is connected to the first step in such manner as to be capable of transmitting the axial and rotational forces normally applied to the leading region for cutting and penetrating without disconnecting from the first step, and to disconnect therefrom upon the application of a final axial force, so that the first step can move between the outer surface of the disconnected region at the leading end of the body and the inner surface of the hole into a telescoped interference fit of the outwardly protruding areas therewith.

19. A bolt as in claim 5, wherein an outwardly projecting flange at the trailing end of the body holds a plate that has been placed around the body so that a final axial force can drive the flange and the plate into tight contact with the surface of the structure to provide support for the surface.

* * * * *